US011262092B2

(12) United States Patent
Horie et al.

(10) Patent No.: US 11,262,092 B2
(45) Date of Patent: Mar. 1, 2022

(54) AIR CONDITIONING SYSTEM INCLUDING A VENTILATOR THAT SUPPLIES HUMIDIFIED OUTDOOR AIR

(71) Applicant: Mitsubishi Electric Corporation, Tokyo (JP)

(72) Inventors: Hayato Horie, Tokyo (JP); Mamoru Hamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 324 days.

(21) Appl. No.: 16/085,145

(22) PCT Filed: Jun. 8, 2016

(86) PCT No.: PCT/JP2016/067023
§ 371 (c)(1),
(2) Date: Sep. 14, 2018

(87) PCT Pub. No.: WO2017/212562
PCT Pub. Date: Dec. 14, 2017

(65) Prior Publication Data

US 2019/0086113 A1 Mar. 21, 2019

(51) Int. Cl.
*F24F 6/00* (2006.01)
*F24F 11/00* (2018.01)
(Continued)

(52) U.S. Cl.
CPC ..... *F24F 11/46* (2018.01); *F24F 1/022* (2013.01); *F24F 1/60* (2013.01); *F24F 3/001* (2013.01);
(Continued)

(58) Field of Classification Search
CPC .. F24F 6/00; F24F 2011/0002; F24F 11/0008; F24F 11/80; F24F 1/0087;
(Continued)

(56) References Cited

U.S. PATENT DOCUMENTS 8,129,662 B2 * 3/2012 Cameron ..... F24D 15/02 219/386
9,810,441 B2 * 11/2017 Dean-Hendricks ..... F24F 11/30
(Continued)

FOREIGN PATENT DOCUMENTS

JP H11-351730 A 12/1999
JP 2002-195740 A 7/2002
(Continued)

OTHER PUBLICATIONS

International Search Report of the International Searching Authority dated Aug. 30, 2016 for the corresponding International application No. PCT/JP2016/067023 (and English translation).

*Primary Examiner* — Jerry-Daryl Fletcher
*Assistant Examiner* — Daniel C Comings
(74) *Attorney, Agent, or Firm* — Posz Law Group, PLC

(57) ABSTRACT

When a humidity condition, including a humidity detected by a temperature and humidity sensor and a humidification load sensing unit falling below a threshold value, is met, an outside air conditioner supplies the heated and humidified air into the room. When the humidity condition is met during the indoor heating operation, the indoor heating operation is stopped or weakened. When the humidity condition is met, only the outside air conditioner is subjected to a heating and humidifying operation. Since the indoor air is not heated by the inside air conditioner more than necessary, when a heating load is low and a humidification load is present, a "conflicting state" can be prevented in which the inside air conditioner is subjected to a cooling and dehumidifying operation and the outside air conditioner is subjected to the heating and humidifying operation.

8 Claims, 11 Drawing Sheets

(51) Int. Cl.

| | |
|---|---|
| ***F24F 11/80*** | (2018.01) |
| ***F24F 11/46*** | (2018.01) |
| ***F24F 1/022*** | (2019.01) |
| ***F24F 1/60*** | (2011.01) |
| ***F24F 11/49*** | (2018.01) |
| ***F24F 11/52*** | (2018.01) |
| ***F24F 3/14*** | (2006.01) |
| ***F24F 11/83*** | (2018.01) |
| ***F24F 3/06*** | (2006.01) |
| ***F24F 11/86*** | (2018.01) |
| ***F24F 3/00*** | (2006.01) |
| ***F24F 11/84*** | (2018.01) |
| *F24F 110/10* | (2018.01) |
| *F24F 110/20* | (2018.01) |
| *F24F 110/12* | (2018.01) |
| *F24F 110/22* | (2018.01) |
| *F24F 1/0087* | (2019.01) |

(52) U.S. Cl.

CPC ..... *F24F 3/065* (2013.01); *F24F 3/14* (2013.01); *F24F 6/00* (2013.01); *F24F 11/0008* (2013.01); *F24F 11/49* (2018.01); *F24F 11/52* (2018.01); *F24F 11/80* (2018.01); *F24F 11/83* (2018.01); *F24F 11/84* (2018.01); *F24F 11/86* (2018.01); *F24F 1/0087* (2019.02); *F24F 2011/0002* (2013.01); *F24F 2110/10* (2018.01); *F24F 2110/12* (2018.01); *F24F 2110/20* (2018.01); *F24F 2110/22* (2018.01)

(58) Field of Classification Search

CPC ..... F24F 1/009; F24F 1/0093; F24F 2203/02; F24F 11/49; F24F 11/84; F24F 1/022; F24F 1/60; G05D 22/00; G05D 22/02

See application file for complete search history.

(56) References Cited

U.S. PATENT DOCUMENTS

| | | | | |
|---|---|---|---|---|
| 10,775,059 | B2 * | 9/2020 | Lee | F24F 3/153 |
| 2015/0362200 | A1 * | 12/2015 | Hamada | F24F 3/065 62/175 |
| 2017/0097165 | A1 * | 4/2017 | Yasuda | F24F 11/89 |

FOREIGN PATENT DOCUMENTS

| | | | | |
|---|---|---|---|---|
| JP | 2009-109151 | A | 5/2009 | |
| WO | WO 2014/136199 | A1 * | 9/2014 | F24F 7/08 |

* cited by examiner

AIR CONDITIONING SYSTEM INCLUDING A VENTILATOR THAT SUPPLIES HUMIDIFIED OUTDOOR AIR

CROSS REFERENCE TO RELATED APPLICATION

This application is a U.S. national stage application of PCT/JP2016/067023 filed on Jun. 8, 2016, the contents of which are incorporated herein by reference.

TECHNICAL FIELD

The present invention relates to an air conditioning system including an inside air conditioner that heats indoor air and an outside air conditioner serving as a ventilator that humidifies outdoor air and supplies the humidified outdoor air into a room.

BACKGROUND ART

Control for reducing a sensible heat load caused by humidification is proposed in order to prevent an increase in cooling load due to the heating capability generated upon humidification in a scene that requires cooling and humidification, such as in a low temperature warehouse or a pantry (for example, see Japanese Patent Laying-Open No. 11-351730).

An air conditioning system for air conditioning of an office is known, which includes an inside air conditioner having a refrigerant circuit (refrigeration cycle) and an outside air conditioner. The refrigerant circuit of the inside air conditioner includes a compressor, a four-way valve, an outdoor heat exchanger, an expansion valve, and an indoor heat exchanger. The compressor, four-way valve, outdoor heat exchanger, expansion valve, and indoor heat exchanger are connected in order by piping. Refrigerant circulates through the refrigerant circuit, allowing the inside air conditioner to adjust the temperature of the indoor air.

The outside air conditioner exchanges indoor air with fresh outdoor air. Specifically, the outside air conditioner supplies outdoor air into a room while discharging indoor air to outside the room. At that time, the outside air conditioner heats and humidifies outdoor air as necessary.

CITATION LIST

Patent Literature

PTL 1: Japanese Patent Laying-Open No 11-351730

SUMMARY OF INVENTION

Technical Problem

A recent office has better heat insulation and better airtightness, with an increasing number of OA appliances. This may lead to a low heating load or the occurrence of cooling load also during wintertime in which heating is usually performed. In contrast, the interior of a room becomes dry and indoor air needs to be humidified in many cases during wintertime. In such cases, an air conditioning system is required that performs a heating and humidifying operation or a cooling and humidifying operation during wintertime.

Controlling for reducing a sensible heat load or reducing a humidification load as disclosed in Japanese Patent Laying-Open No. 11-351730 can be applied in the cooling and humidifying operation. In the heating and humidifying operation, however, such control cannot be applied especially when the sensible heat load is relatively low.

If the sensible heat load is low during the heating and humidifying operation, a heating amount generated in the outside air conditioner after performing the heating and humidifying operation is supplied into the room, in addition to a heating amount generated in the inside air conditioner after performing an indoor heating operation. Consequently, the heating amount exceeds the sensible heat load, and the indoor temperature reaches a target temperature before the indoor humidity reaches a target humidity.

Thus, the heating and humidifying operation is continued until the target humidity is reached on the outside air conditioner side, while the indoor heating operation using the inside air conditioner is stopped. In this state, though the room temperature has reached the target temperature, the room temperature further increases as the heating amount generated by the outside air conditioner due to the heating and humidifying operation is continuously supplied. Once the room temperature exceeds a set temperature to some extent, a cooling operation using the inside air conditioner is started to reduce the room temperature.

A heating and humidifying operation using the outside air conditioner is performed while a cooling and dehumidifying operation using the inside air conditioner is eventually performed, resulting in a state in which energy is consumed unnecessarily by conflicting operations (a state in which cooling and dehumidication is performed simultaneously with heating and humidification, hereinafter referred to as a "conflicting state").

The present invention has been made to solve the above problem, and has an object to provide an air conditioning system capable of avoiding a conflicting state in which a heating and humidifying operation is performed using an outside air conditioner while performing a cooling and dehumidifying operation using an inside air conditioner, thus reducing unnecessary energy consumption.

Solution to Problem

The present invention relates to an air conditioning system, which includes a detection unit, a ventilator, and an indoor unit. The detection unit is configured to detect humidity of indoor air. The ventilator is configured to, when the detected humidity detected by the detection unit is lower than a threshold value, introduce air from outside a room, heat and humidify the air, and supply the heated and humidified air into the room. The indoor unit is configured to heat the indoor air by an indoor heating operation. Electric power consumed in the indoor heating operation when the detected humidity is lower than the threshold value is lower than electric power consumed in the indoor heating operation when the detected humidity is higher than the threshold value.

Advantageous Effects of Invention

The present invention can avoid a "conflicting state" occurring as a result of the cooling and dehumidifying operation using the inside air conditioner and the heating and humidifying operation using the outside air conditioner when a heating load and a humidification load are present, thus reducing unnecessary energy consumption.

DESCRIPTION OF EMBODIMENTS

Figure 1:
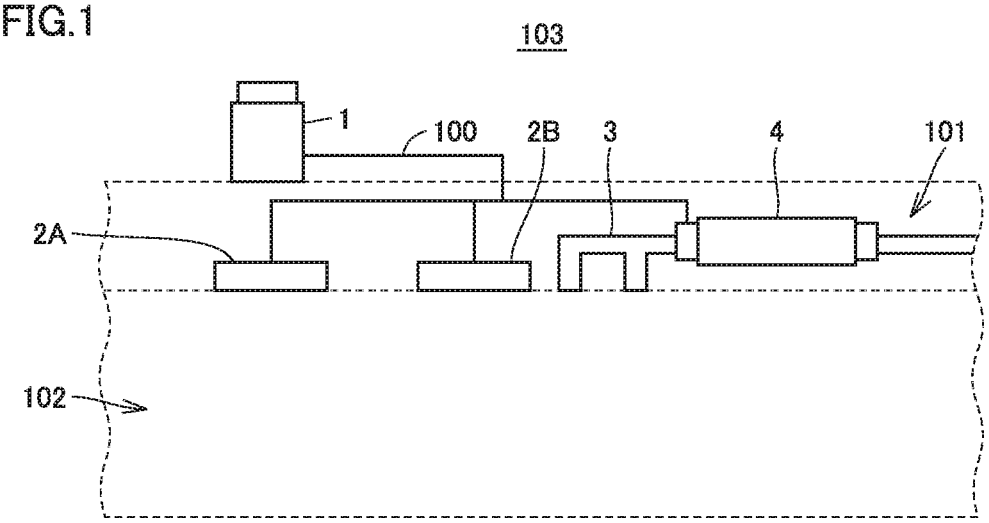
FIG. 1 shows a configuration of an air conditioning system 103 in Embodiment 1 of the present invention.

Embodiments of the present invention will be described below in detail with reference to the drawings. Although several embodiments will be described below, an appropriate combination of the configurations described in the respective embodiments has been intended at the time of application. The same or corresponding parts will be designated by the same reference numerals, and a description thereof will not be repeated.

Embodiment 1

<Configuration>

FIG. 1 shows a configuration of an air conditioning system 103 in Embodiment 1 of the present invention. Air conditioning system 103 includes an outside air conditioner 4, an outdoor unit 1, and inside air conditioners 2A and 2B. Outside air conditioner 4, inside air conditioners 2A and 2B, and outdoor unit 1 are connected to one another by a refrigerant pipe 100. Although the example shown in FIG. 1 includes multiple inside air conditioners and a single outside air conditioner, a single inside air conditioner or multiple outside air conditioners may be provided. Inside air conditioners 2A and 2B are arranged facing the interior of a room 102, and outdoor unit 1 is arranged outside the room. Outside air conditioner 4 is arranged, for example, in a space 101 behind the ceiling, and an outlet of a duct 3 is arranged in a room.

Outside air conditioner 4 introduces outdoor air through duct 3 and humidifies the introduced air, and then supplies the humidified air into the room. An inside air conditioner 2 adjusts the temperature of indoor air.

Figure 2:
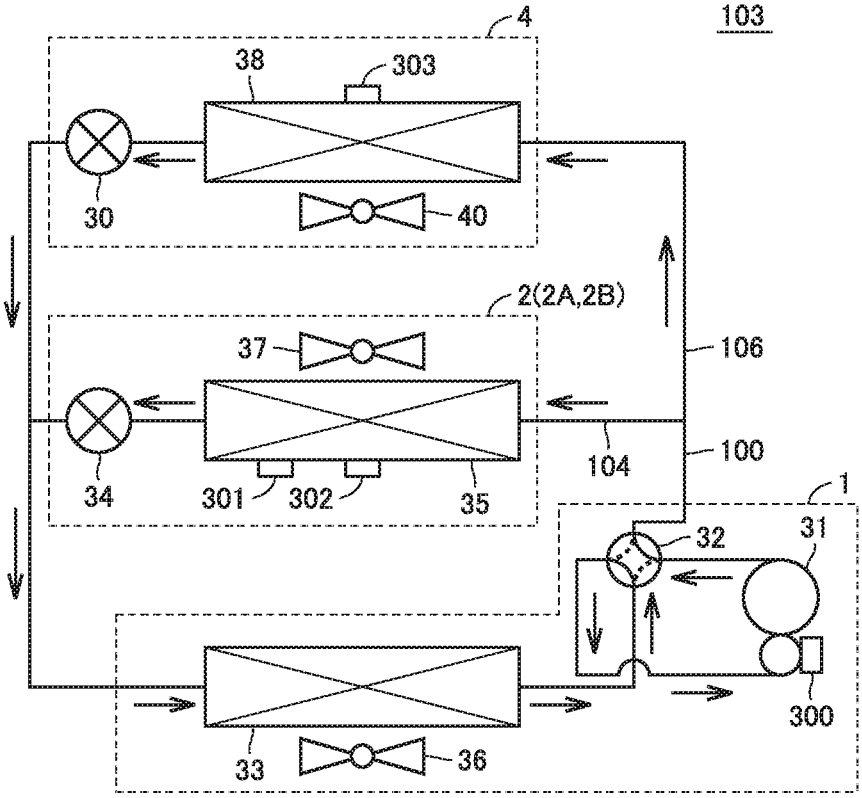
FIG. 2 is a refrigerant circuit diagram of air conditioning system 103 in Embodiment 1 of the present invention.

FIG. 2 is a refrigerant circuit diagram of air conditioning system 103 in Embodiment 1 of the present invention. Arrows in FIG. 2 indicate a flow of refrigerant during a heating operation. Inside air conditioners 2A and 2B in FIG. 1 are shown representatively as inside air conditioner 2 in FIG. 2. Hereinafter, inside air conditioners 2A and 2B may be collectively referred to as inside air conditioner 2.

As shown in FIG. 2, in air conditioning system 103, inside air conditioner 2 and outside air conditioner 4 are connected in parallel to outdoor unit 1 by refrigerant pipes 100, 104, and 106.

Outdoor unit 1 includes a compressor 31, a four-way valve 32, an outdoor heat exchanger 33, a blower 36, and a compressor frequency control unit 300.

Inside air conditioner 2 includes an indoor heat exchanger 35, an expansion valve 34, an inside-air-conditioner heating capability sensing unit 301, an indoor temperature sensing unit 302, and a blower 37. Although FIG. 2 does not individually show inside air conditioners 2A and 2B to prevent complexity of the drawing, inside air conditioners 2A and 2B have the same configuration, and inside air conditioner 2B is connected in parallel to inside air conditioner 2A between outdoor heat exchanger 33 and four-way valve 32.

Outside air conditioner 4 includes a ventilation heat exchanger 38, an expansion valve 30, an outside-air-conditioner heating capability sensing unit 303, and a blower 40.

FIG. 2 shows a state in which four-way valve 32 is set for heating, and refrigerant flows in the direction of the arrows. Compressor 31, four-way valve 32, ventilation heat exchanger 38, indoor heat exchanger 35, expansion valves 30 and 34, and outdoor heat exchanger 33 are connected to each other by refrigerant pipes 100, 104, and 106 for refrigerant to circulate therethrough, constituting a refrigerant circuit.

Compressor 31 sucks and compresses refrigerant, and discharges the refrigerant as high-temperature, high-pressure gas refrigerant. Compressor 31 has, for example, an inverter therein. Compressor frequency control unit 300 controls an operation frequency (rotation speed) of compressor 31. This controls a capacity (an amount of refrigerant discharged per unit time) of compressor 31.

Both of ventilation heat exchanger 38 and indoor heat exchanger 35 operate as condensers during heating. Ventilation heat exchanger 38 performs heat exchange between the refrigerant discharged from compressor 31 and the outdoor air introduced by blower 40 for air supply, and condenses the refrigerant. Indoor heat exchanger 35 performs heat exchange between the refrigerant discharged from compressor 31 and the indoor air flowed by blower 36 for an indoor heat exchanger, and condenses the refrigerant.

Expansion valve 30 decompresses the refrigerant from ventilation heat exchanger 38. Expansion valve 34 decompresses the refrigerant from indoor heat exchanger 35. The degrees of opening of expansion valves 30 and 34 are controlled, so that the decompression amount of the refrigerant is controlled.

Outdoor heat exchanger 33 operates as an evaporator during heating, performs heat exchange between the refrigerant from expansion valves 30 and 34 and the outdoor air, and evaporates the refrigerant.

Figure 3:
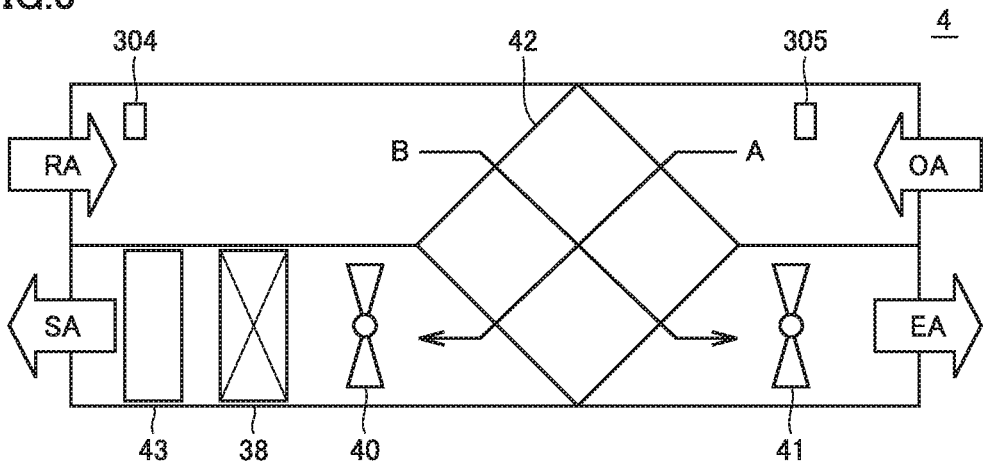
FIG. 3 shows an example configuration of an outside air conditioner.

FIG. 3 shows an example configuration of the outside air conditioner. As shown in FIG. 3, outside air conditioner 4 includes in a casing of a body, ventilation heat exchanger 38, a total heat exchanger 42, blower 40 for air supply, a blower 41 for air exhaustion, a humidifier 43, a humidification load sensing unit 304, and an outside air temperature and humidity sensing unit 305.

Two air ducts are provided adjacent to each other inside outside air conditioner 4. Blower 40 for air supply and blower 41 for air exhaustion are provided in the air duct on one side (the lower side of the sheet), and total heat exchanger 42 is placed across the two air ducts between blower 40 and blower 41. Ventilation heat exchanger 38 and humidifier 43 are placed in order downstream of blower 40. In an air duct in which blower 40 and the like are not placed (an air duct on the upper side of the sheet), humidification load sensing unit 304 and outside air temperature and humidity sensing unit 305 for inside a room are placed. Humidification load sensing unit 304 and outside air temperature and humidity sensing unit 305 sense, for example, a humidification load as well as the temperature and humidity of outdoor air from outputs of the temperature and humidity sensor.

The two air ducts intersect each other at total heat exchanger 42. As indicated by the arrows in FIG. 3, a supply ventilation air duct A and an exhaust ventilation air duct B are formed independently inside the casing of the body. Supply ventilation air duct A is a ventilation air duct through which outdoor air OA is introduced by blower 40 and is heated and humidified, and is then supplied into the room. Exhaust ventilation air duct B is a ventilation air duct through which indoor air RA is introduced by blower 41 for air exhaustion and is exhausted to outside the room.

Total heat exchanger 42 has a structure in which, for example, ventilation air ducts orthogonal to each other are placed one over the other. Indoor air RA and outdoor air OA pass through the ventilation air ducts, so that total heat exchange is performed between indoor air RA and outdoor air OA.

A flow of air passing through outside air conditioner 4 will be described. First, outdoor air OA is guided by blower 40 for air supply to total heat exchanger 42, passes through ventilation heat exchanger 38, and then passes through humidifier 43, so that supply air SA is supplied into the room. In contrast, indoor air RA passes through total heat exchanger 42 by blower 41 for air exhaustion, and is then exhausted to outside the room as exhaust air EA.

Humidifier 43 may be, for example, a vaporizing humidifier capable of adjusting a flow rate of water. When indoor humidification is required, ventilation heat exchanger 38 functions as a condenser and heats the air. Also, when indoor humidification is required, humidifier 43 is supplied with water. The heated air passes through humidifier 43, so that air is humidified and supplied into the room.

In contrast, when indoor humidification is not required, expansion valve 30 is closed so as not to allow refrigerant to flow to ventilation heat exchanger 38.

When the heating capabilities of inside air conditioners 2A and 2B or the humidification capability of outside air conditioner 4 is to be adjusted, compressor frequency control unit 300 is used to adjust an operation frequency of compressor 31 or manipulate the degree of opening of expansion valve 34. Specifically, the operation frequency of compressor 31 is adjusted to adjust a condensation temperature CT of refrigerant, and the degrees of opening of expansion valves 34 and 30 are adjusted to adjust the degrees of supercooling refrigerant in indoor heat exchanger 35 and ventilation heat exchanger 38, respectively.

Figure 4:
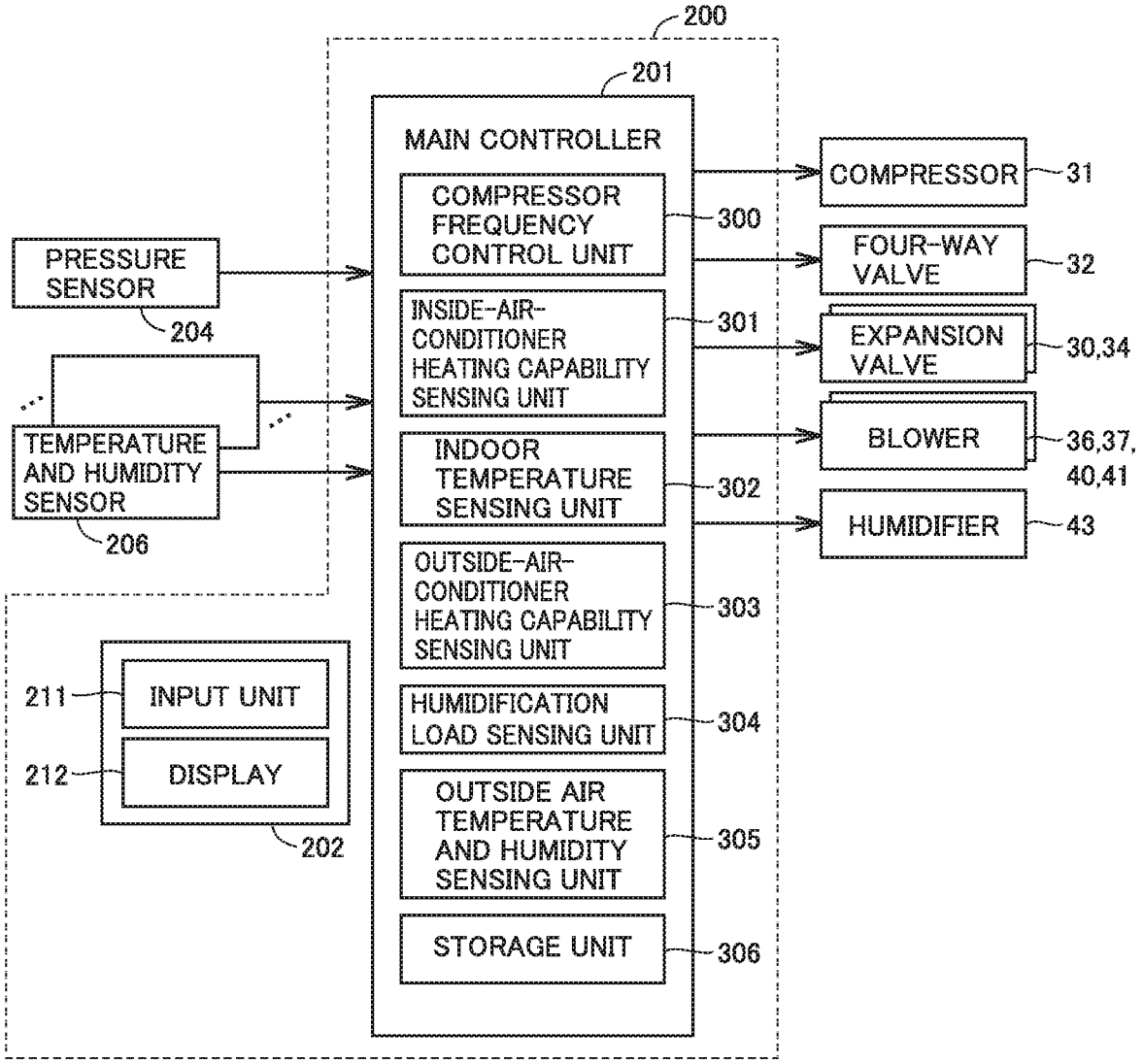
FIG. 4 is a block diagram for illustrating a configuration for control of air conditioning system 103.

FIG. 4 is a block diagram for illustrating a configuration for control of air conditioning system 103. With reference to FIG. 4, controller 200 includes a main controller 201 that controls air conditioning system 103 and a remote control 202. Main controller 201 includes components such as a receiving circuit capable of reading commands from remote control 202, though not shown in FIG. 4.

In the following description, a sensor group is a generic term including various temperature and humidity sensors 206 and a pressure sensor 204. An actuator group is a generic term including compressor 31, four-way valve 32, expansion valves 30 and 34, and blowers 36, 37, 40, and 41.

Main controller 201 includes a compressor frequency control unit 300, an inside-air-conditioner heating capability sensing unit 301, an indoor temperature sensing unit 302, an outside-air-conditioner heating capability sensing unit 303, a humidification load sensing unit 304, an outside air temperature and humidity sensing unit 305, and a storage unit 306.

Main controller 201 reads various amounts sensed by pressure sensor 204 and various temperature and humidity sensors 206. Main controller 201 then performs a control operation based on the various amounts that have been read, thus controlling the actuator group.

Main controller 201 includes built-in storage unit 306 that stores a predetermined constant, a setup value transmitted from remote control 202, or the like. Main controller 201 can refer to or rewrite the content thereof as required.

Compressor frequency control unit 300, inside-air-conditioner heating capability sensing unit 301, indoor temperature sensing unit 302, outside-air-conditioner heating capability sensing unit 303, humidification load sensing unit 304, and outside air temperature and humidity sensing unit 305 described above are configured with microcomputers, and storage unit 306 is configured with a semiconductor memory or the like.

Although FIGS. 2 and 3 show the example in which compressor frequency control unit 300, inside-air-conditioner heating capability sensing unit 301, indoor temperature sensing unit 302, outside-air-conditioner heating capability sensing unit 303, humidification load sensing unit 304, and outside air temperature and humidity sensing unit 305 are disposed separately, they may be disposed in other places. For example, these functions may be implemented together by one microcomputer, or may be divided to a plurality of microcomputers in any combination.

A user can input, via remote control 202, commands to control ON/OFF of cooling, ON/OFF of heating, and ON/OFF of ventilation, indoor set temperature, indoor set humidity, or the like through input unit 211. Main controller 201 can read setting data based on a user's operation.

Remote control 202 is provided with a display 212 for displaying a current operation mode, a set temperature, a set humidity, and a message for the user.

<Operations>

Figure 5:
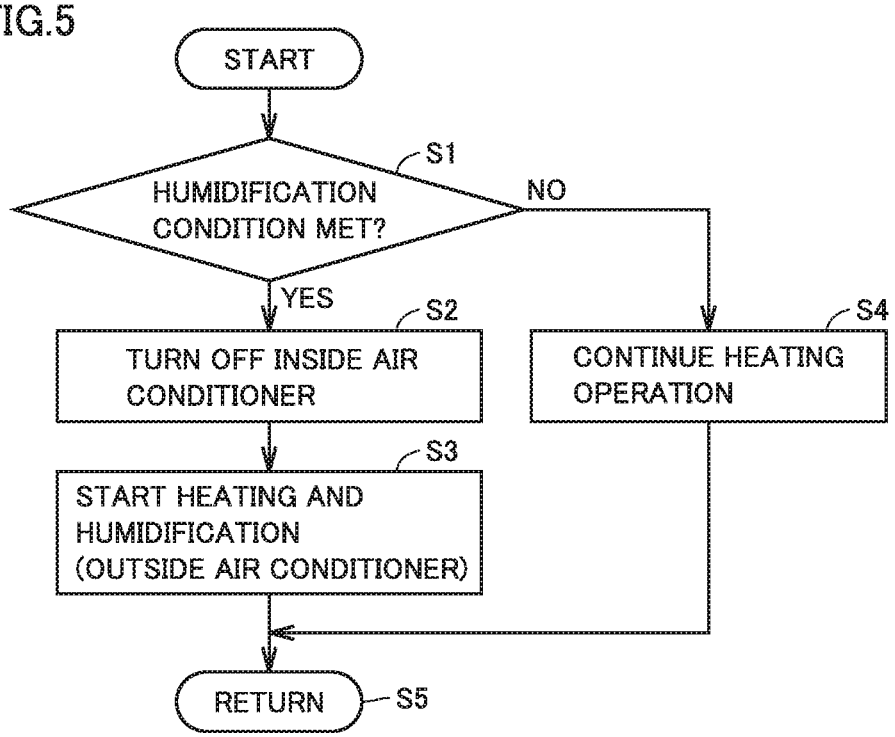
FIG. 5 is a flowchart showing control for changing the operation states of an inside air conditioner and an outside air conditioner in the present invention.

Operations of air conditioning system 103 in Embodiment 1 of the present invention will now be described. FIG. 5 is a flowchart showing control for changing the operation states of the inside air conditioner and the outside air conditioner in the present invention. The processes of this flowchart are executed in controller 200 of FIG. 4. Controller 200 can be implemented as hardware such as a circuit device that implements these functions, or software executed on an arithmetic unit such as a microcomputer or CPU.

With reference to FIG. 5, controller 200 first determines whether a humidity condition has been met in step S1. Specifically, when a heating load and a humidification load are present in the room, controller 200 causes humidification load sensing unit 304 to sense the humidification load and determines whether the humidification load is greater than a reference value set in advance. For example, when a current indoor absolute humidity is lower than a target indoor absolute humidity set in advance and a difference between these humidities is greater than 10 g/kg', controller 200 determines that the humidification load is greater than the reference value. When the humidification load is greater than the reference value, controller 200 determines that the humidity condition is met. In this case, when the detected humidity of the indoor air is lower than a determination threshold value corresponding to the reference value, the humidity condition is met.

When the humidity condition has been met (YES in step S1), controller 200 closes expansion valve 34 at the outlet portion of inside air conditioner 2 to stop the indoor heating operation using inside air conditioner 2 (step S2). Controller 200 then starts the heating and humidifying operation using outside air conditioner 4 (step S3). In the heating and humidifying operation, expansion valve 30 is opened to cause high-temperature refrigerant to flow into ventilation heat exchanger 38 and also cause water to be supplied to humidifier 43.

With reference to FIG. 3, outdoor air OA introduced from outside the room by blower 40 is heated by ventilation heat exchanger 38 that functions as a condenser. The heated air passes through humidifier 43, so that the humidified air is supplied into the room. Thus, supply air SA having higher temperature and higher humidity than those of outdoor air is supplied into the room. Since the indoor heating operation is stopped on the inside air conditioner 2 side as described above, the indoor air is heated and humidified only by outside air conditioner 4.

In contrast, when the humidity condition is not met (NO in step S1), the process is advanced to step S4, so that the current heating operation state is continued. As shown in FIG. 5, from step S3 or step S4, the process advances to step S5, which is a return.

As described above, when a heating load and a humidification load are present in the room, if the humidification load of indoor air RA sensed by humidification load sensing unit 304 is greater than the reference value, the indoor heating operation using inside air conditioner 2 is stopped, and the heating and humidifying operation using outside air conditioner 4 is performed. In contrast, if the sensed humidification load of indoor air RA is lower than the reference value, the current operation is continued.

When the indoor heating operation using inside air conditioner 2 is stopped and the heating and humidifying operation using outside air conditioner 4 is performed, if the humidification load sensed by humidification load sensing unit 304 decreases to the value smaller than or equal to the reference value (if the humidification load is sufficiently low), the indoor heating operation using inside air conditioner 2 is started. At this time, outside air conditioner 4 closes expansion valve 34 to interrupt refrigerant flowing into ventilation heat exchanger 38 and guides the outdoor air flowing into the humidifier to humidifier 43 without heating. Since the air guided to humidifier 43 has not been heated, it contains a smaller amount of moisture to be humidified by humidifier 43 than in the heating and humidifying operation. This leads to decreased heating amount and decreased humidification amount that are to be supplied into the room by outside air conditioner 4.

Figure 6:
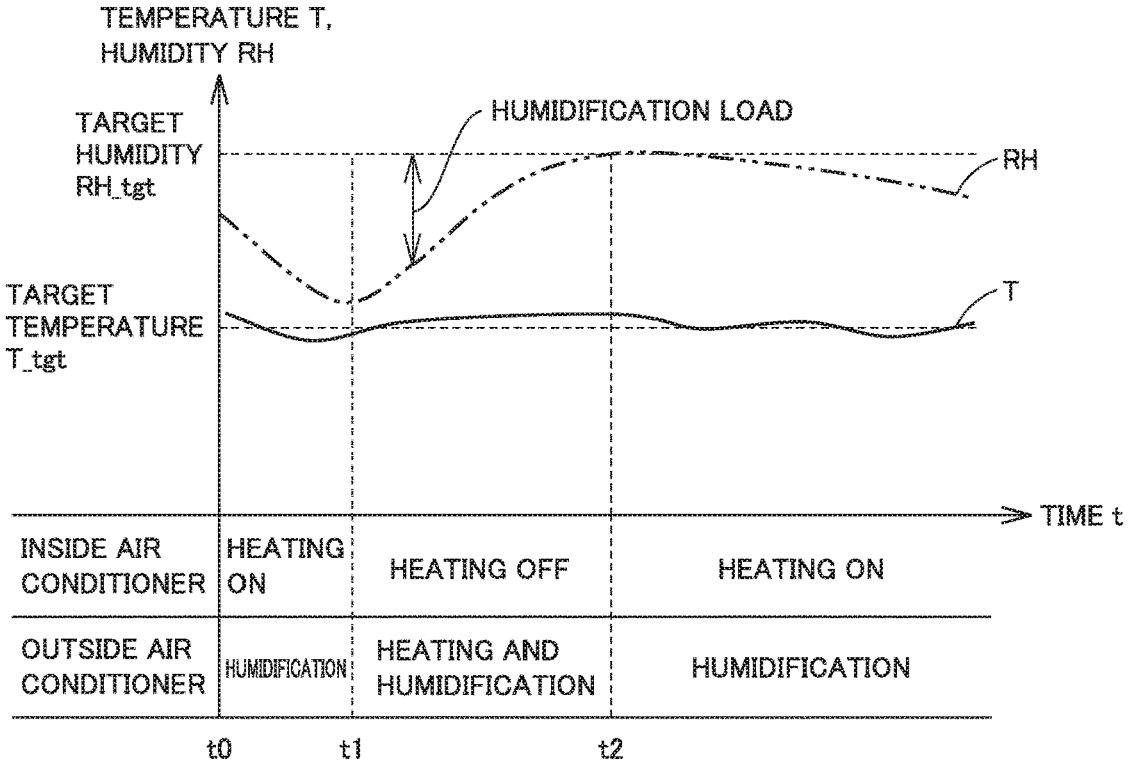
FIG. 6 shows a first example of time variations in indoor air temperature.

FIG. 6 shows a first example of time variations in indoor air temperature. FIG. 6 shows a target humidity RH_tgt of indoor air and a target temperature T_tgt of indoor temperature. As shown in FIG. 6, for example, at a time t0 to a time t1, the indoor heating operation is first performed on the inside air conditioner 2 side, and the humidifying operation is performed on the outside air conditioner 4 side. At time t1, when the humidification load is higher than a reference value, the indoor heating operation is stopped on the inside air conditioner 2 side, and the heating and humidifying operation is performed on the outside air conditioner 4 side.

The magnitude of a humidification load is determined based on a difference between a humidity RH and target humidity RH_tgt or a difference between an absolute humidity X and a target absolute humidity X_tgt. Absolute humidity X can be calculated from humidity RH and temperature T, which have been measured.

At this time, the indoor temperature and indoor humidity rise because of the heating capability and humidification capability of outside air conditioner 4. At time t2, when the humidification load is smaller than the reference value, the indoor heating operation is started on the inside air conditioner 2 side, and the humidifying operation is performed on the outside air conditioner 4 side.

Since inside air conditioner 2 and outside air conditioner 4 are controlled such that air conditioning system 103 processes a humidification load and then processes a heating load as described above, the occurrence of a "conflicting state" can be avoided when a heating load and a humidification load are present in the room. Subsequently, the indoor heating operation is restarted after the humidification load has been processed, and the humidifying operation is performed on the outside air conditioner 4 side, allowing both of the indoor heating load and the indoor humidification load to be processed finally. The completion of the process for humidification load is determined by humidity reaching the target humidity. The completion of the process for the heating load is determined by the room temperature reaching the target temperature.

Figure 7:
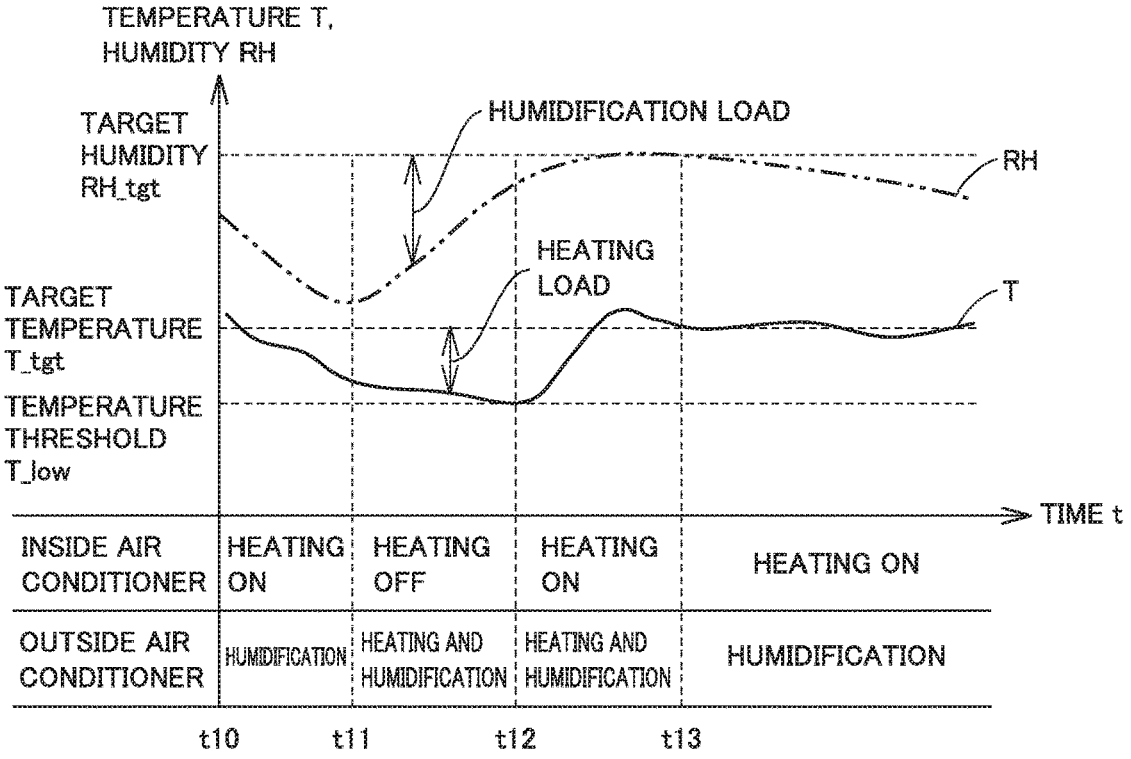
FIG. 7 shows a second example of time variations in indoor air temperature.

FIG. 7 shows a second example of time variations in indoor air temperature. As indicated at a time t11 to a time t12 of FIG. 7, since the indoor heating load is high while the operation is stopped on the inside air conditioner 2 side and the heating and humidifying operation is performed on the outside air conditioner 4 side, indoor air temperature may drop due to the lack of heating capability only by the outside air conditioner 4. In that case, when the indoor heating load exceeds a preset reference value, the indoor heating operation is started on the inside air conditioner 2 side. For example, when a difference between an indoor temperature T obtained by indoor temperature sensing unit 302 and target value T_tgt of indoor temperature is greater than the reference value, it can be determined that the heating load has exceeded the reference value. Herein, the room temperature corresponding to the preset reference value corresponds to a temperature threshold T_Low shown in FIG. 7. That is, when the indoor temperature T decreases to meet T<T_Low, the indoor heating operation is started on the inside air conditioner 2 side.

Figure 8:
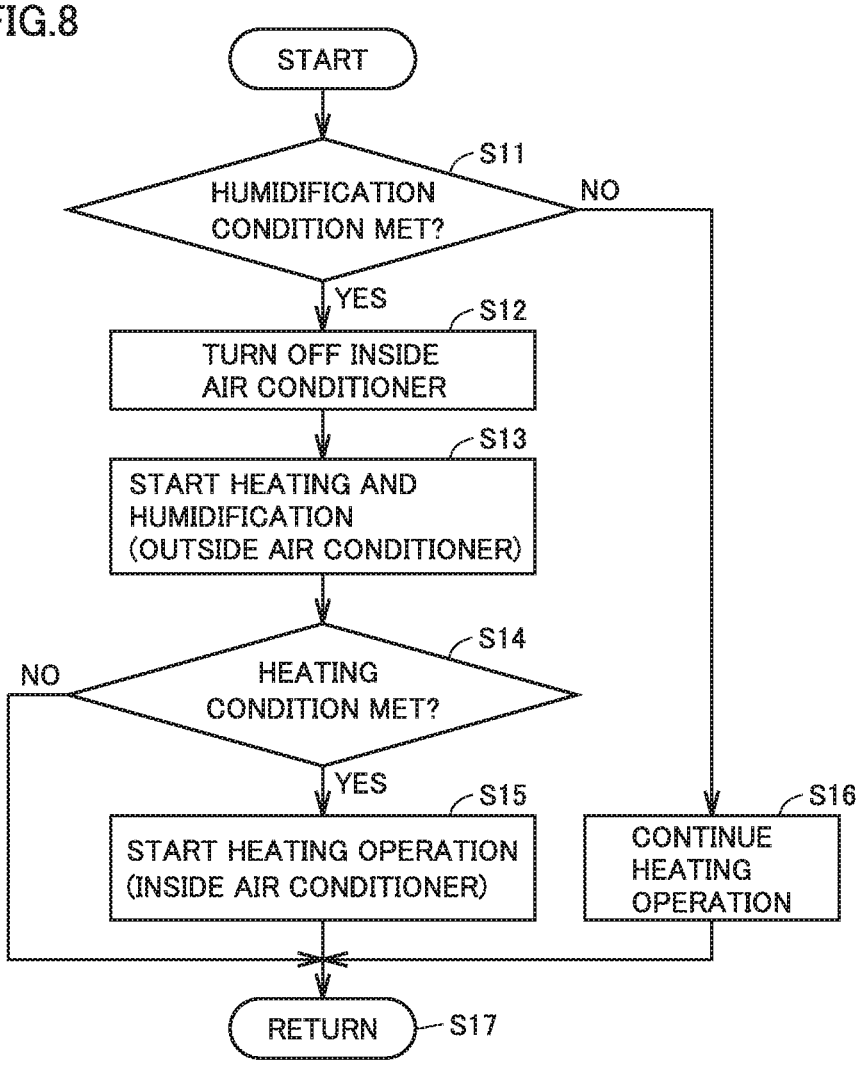
FIG. 8 is a flowchart for illustrating control that accommodates to variations in room temperature in FIG. 7.

FIG. 8 is a flowchart for illustrating control that accommodates to changes in room temperature of FIG. 7. Since the processes of steps S11 to S13 of FIG. 8 are respectively identical to the processes of steps S1 to S3 of FIG. 5, description thereof will not be repeated here.

In step S14, whether the heat condition has been met is determined. For example, when a difference between an indoor temperature T obtained by indoor temperature sensing unit 302 and target value T_tgt of indoor temperature is greater than a reference value (when the heating load exceeds the reference value), it can be determined that the heating condition is met.

When the heating condition is met in step S14 (YES in S14), the process is advanced to step S15 to start the indoor heating operation on the inside air conditioner 2 side, and is then advanced to step S17. When the heating condition is not met in step S14 (NO in S14), the process of step S15 is not performed, and the process is advanced to step S17.

When determination is NO in step S11, the heating operation is continued in step S16, and then, the process is advanced to step S17.

In step S17, the process is returned back to the main routine.

Even when the indoor heating load is high and the room temperature drops due to the lack of heating capability only by the heating and humidification of outside air conditioner 4, control as shown in FIG. 8 allows the indoor heating operation using inside air conditioner 2 to be performed while avoiding the "conflicting state," thus preventing a significant drop in room temperature.

Figure 9:
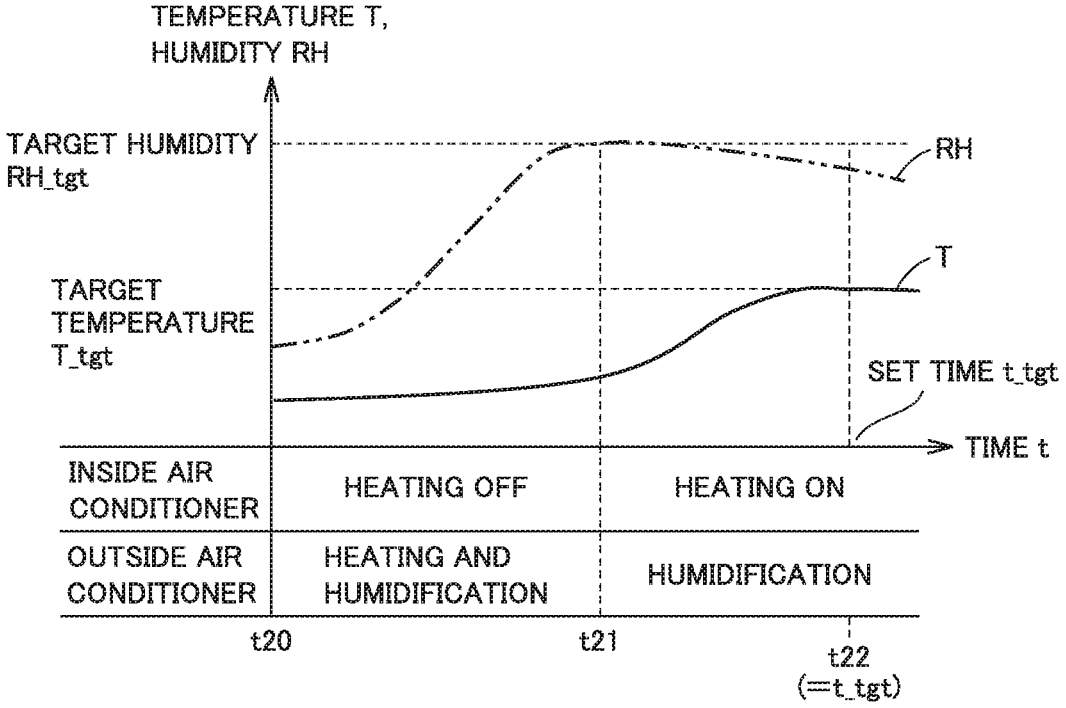
FIG. 9 shows a third example of time variations in indoor air temperature.

FIG. 9 shows a third example of time variations in indoor air temperature. When a time to start using a room is determined in advance, such as an opening time of an office or an opening time of a store, it is convenient to automatically start operation using a timer. In this case, the air conditioning system is caused to start operation such that an indoor temperature T and a humidity RH satisfy target values T_tgt and RH_tgt by a set time (t_tgt).

On that occasion, as shown in t20 to t21 of FIG. 9, in order to avoid the "conflicting state," outside air conditioner 4 first performs the heating and humidifying operation to process a humidification load, and then, inside air conditioner 2 performs the indoor heating operation at t21 and thereafter.

The above control can avoid the "conflicting state" while satisfying the target temperature humidity at a set time. This improves the controllability of a startup operation on a day, thus providing a system more convenient for a user.

Figure 10:
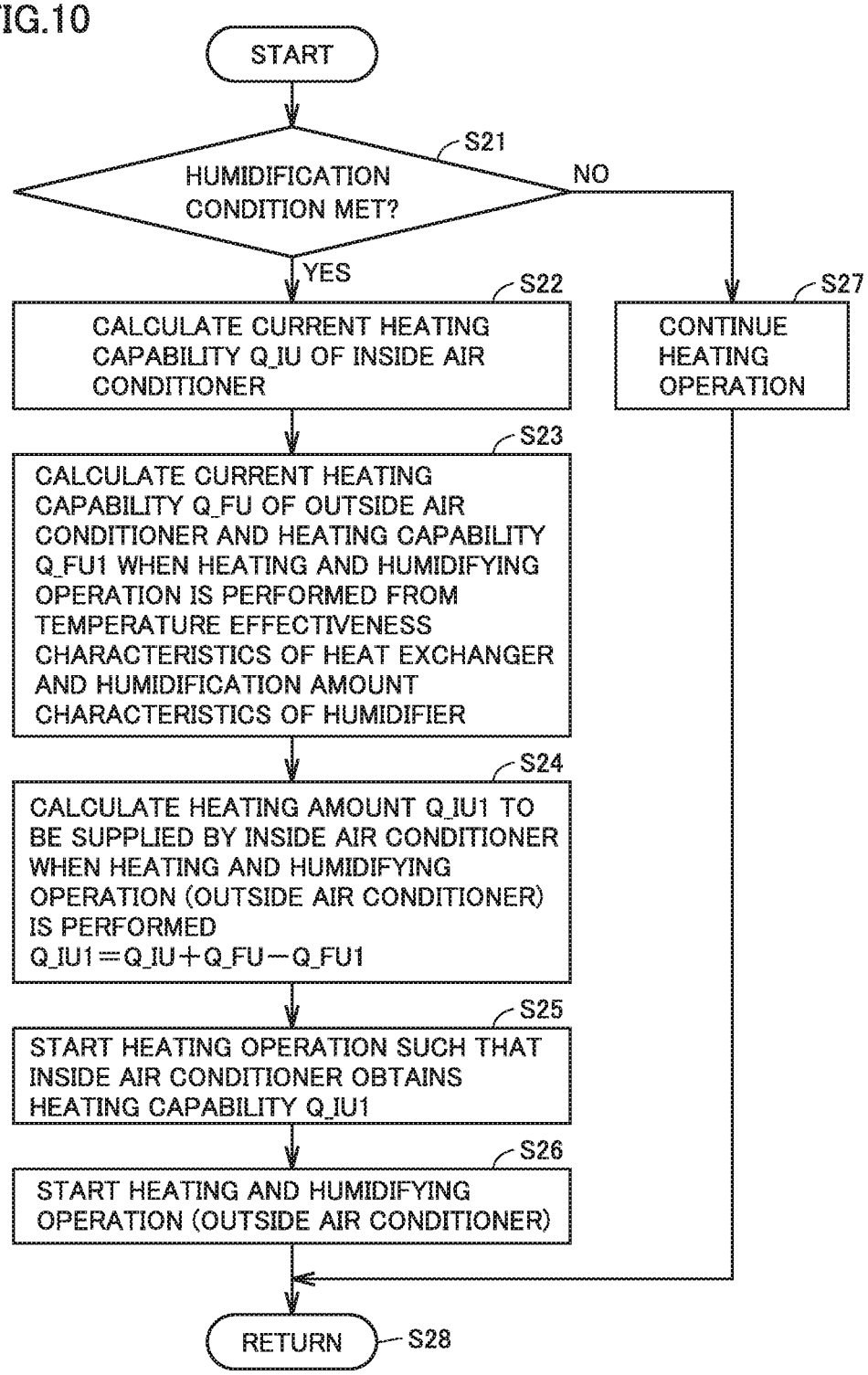
FIG. 10 is a flowchart for illustrating a process for more precise control.

FIG. 10 is a flowchart for illustrating a process performed when more precise control is performed. In the process of the flowchart of FIG. 10, the "current heating capability of inside air conditioner 2" is changed (reduced or turned off) so as to obtain a "heating amount to be supplied by inside air conditioner 2 when the process shifts to the heating and humidifying operation using outside air conditioner 4." This prevents the indoor temperature from rising excessively due to the current heating capability of inside air conditioner 2 being exceeded, thus preventing inside air conditioner 2 from shifting to cooling.

As shown in FIG. 10, when determining in step S21 that the humidity condition has been met (humidification load is greater than a reference value) (YES in S21), in step S22, controller 200 calculates a current heating capability Q_IU of inside air conditioner 2.

Heating capability Q_IU is sensed by inside-air-conditioner heating capability sensing unit 301 of inside air conditioner 2 before the heating and humidifying operation using outside air conditioner 4 is started. Inside-air-conditioner heating capability sensing unit 301 determines a flow rate Gr (kg/s) of the refrigerant and an enthalpy change Δh (kj/kg) of the refrigerant from a rotation speed of a compressor, a degree of opening of expansion valve 34 of inside air conditioner 2, and a pipe temperature of indoor heat exchanger 35, and calculates a heating capability Q_IU by Equation (1) below. The calculated heating capability Q_IU is stored once in storage unit 306 (such as an internal memory).

$$Q_IU=Gr*\Delta h \quad (1)$$

In step S23, a current heating capability Q_FU of outside air conditioner 4 and a heating capability Q_FU1 during the heating and humidifying operation are subsequently calculated from the temperature effectiveness characteristics of ventilation heat exchanger 38 and the humidification amount characteristics of humidifier 43. Heating capability Q_FU is sensed by outside-air-conditioner heating capability sensing unit 303 of outside air conditioner 4. Outside-air-conditioner heating capability sensing unit 303 calculates heating capability Q_FU in the following process.

A temperature T_LO of air that has passed through total heat exchanger 42 is determined by Equation (2) below using a relationship between an air volume and temperature effectiveness of total heat exchanger 42 that is held in advance.

$$T_LO=T_OA-\eta_1*(T_OA-T_RA) \quad (2)$$

where T_RA represents an indoor air temperature, T_OA represents an outside air temperature, and η_1 represents temperature effectiveness of total heat exchanger 42.

Subsequently, current heating capability Q_FU of outside air conditioner 4 is calculated by Equation (3) below using an air volume W[$m^3$/s] of outside air conditioner 4, an air specific heat Cp [kJ/K*kg], and air density ρ (kg/$m^3$). The calculated heating capability Q_FU is stored once in storage unit 306 (such as an internal memory).

$$Q_FU=W*Cp*p*(T_LO-T_RA) \quad (3)$$

In this case, a heating capability Q supplied into the room is a sum of the heating capabilities of inside air conditioner 2 and outside air conditioner 4. That is to say, Q=Q_IU+Q_FU. This heating capability Q is stored once in storage unit 306 (such as an internal memory) as a heating load.

Suppose that the heating capability at the start of the heating and humidifying operation using outside air conditioner 4 is Q_FU1, a value obtained by subtracting Q_FU1 from Q described above is a heating load that cannot be processed by the heating capability of outside air conditioner 4. Suppose that the heating capability of inside air conditioner 2 is Q_IU1, the heating capability of inside air conditioner 2 is calculated by Equation (4), and inside air conditioner 2 is adjusted so as to achieve this heating capability.

$$Q_IU1=Q-Q_FU1 \quad (4)$$

That is to say, a total heating capability Q is calculated from heating capability Q_FU of outside air conditioner 4 and heating capability Q_IU of inside air conditioner 2 before start of the heating and humidifying operation using outside air conditioner 4, and heating capability Q_FU1 of outside air conditioner 4 after start of the heating and humidifying operation is subtracted from this heating capability Q. Consequently, heating capability Q_IU1 of inside air conditioner 2 after start of the heating and humidifying operation using outside air conditioner 4 is determined, and inside air conditioner 2 is controlled so as to achieve heating capability Q_IU1, enabling more accurate processing of both of a heating load and a humidification load.

Steps S24, S25, S26, S27 and S28 are described by the corresponding text in the flowchart of FIG. 10.

In an example of the method of adjusting heating capability Q_IU1 of inside air conditioner 2, a frequency of compressor 31 is manipulated. That is to say, a condensation temperature CT of the refrigerant rises by increasing the frequency of a compressor, leading to an increase in heating capability.

In an example of the method of determining heating capability Q_FU1 of outside air conditioner 4 used in Equation (4) above, temperature effectiveness characteristics of ventilation heat exchanger 38 and humidification amount characteristics of humidifier 43, described below, are used herein.

Figure 11:
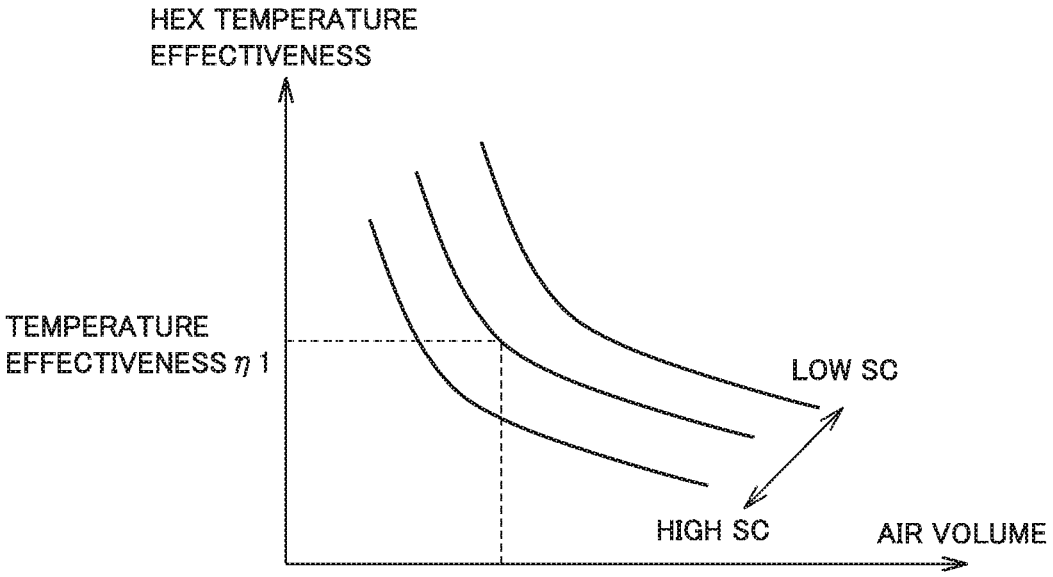
FIG. 11 shows a relationship between an air volume held in advance in a controller 200 and temperature effectiveness of a ventilation heat exchanger 38.

Controller 200 can calculate a temperature T_HEX_O of the air that has passed through ventilation heat exchanger 38, using a relationship between an air volume and temperature effectiveness of ventilation heat exchanger 38 which is held in advance in controller 200 (FIG. 11).

In the use of FIG. 11, an air volume and a degree of supercooling SC first need to be measured or estimated. For example, an air volume may be measured by an air volume sensor, or may be estimated using a relationship between an air volume (such as strong or weak) set by a user with a remote control and a value in a catalog. Degree of supercooling SC can be determined by measuring the pipe temperature of ventilation heat exchanger 38. Alternatively, degree of supercooling SC may be set using a control target value (e.g., control is made to attain SC=20K if outside air temperature is high). Temperature effectiveness η1 can be determined from the obtained air volume and degree of supercooling SC. An air temperature T_HEX_O is represented using these parameters by Equation (5) below.

$$T_HEX_O = T_HEX_I - \eta 1 * (T_HEX_I - CT) \quad (5)$$

where T_HEX_I represents the temperature of air flowing into ventilation heat exchanger 38, and CT represents the condensation temperature of the refrigerant. T_HEX_I is determined by, for example, the temperature effectiveness of outside air temperature and humidity sensing unit 305 and the temperature effectiveness of total heat exchanger 42. CT is, for example, a refrigerant temperature measured by a temperature sensor placed in ventilation heat exchanger 38 and has a value substantially equal to the condensation temperature of the refrigerant.

Figure 12:
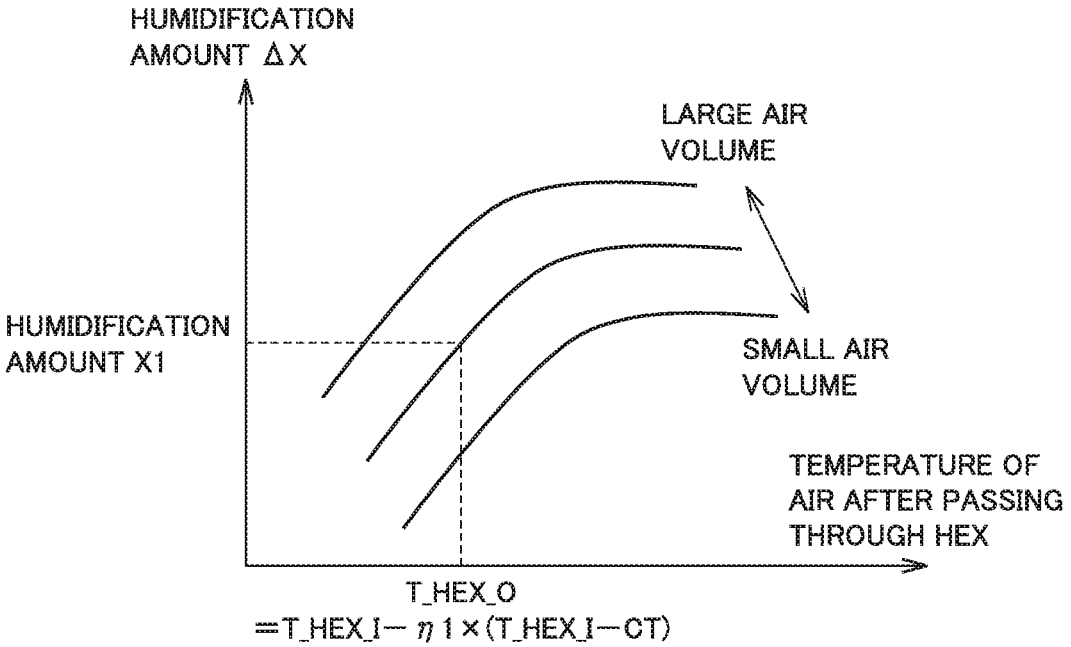
FIG. 12 shows a relationship between an air temperature T_HEX_O and a humidification amount ΔX after air has passed through ventilation heat exchanger 38, which is held in advance in controller 200 for each air volume.

Controller 200 holds a relationship between air temperature T_HEX_O after air has passed through ventilation heat exchanger 38 and humidification amount ΔX for each air volume (FIG. 12). Thus, a humidification amount X1 can be determined from T_HEX_O and air volume.

Herein, humidification amount X1 is a difference between a target humidity and a current humidity. The current humidity can be sensed by, for example, a humidity sensor included in outside air conditioner 4.

Figure 13:
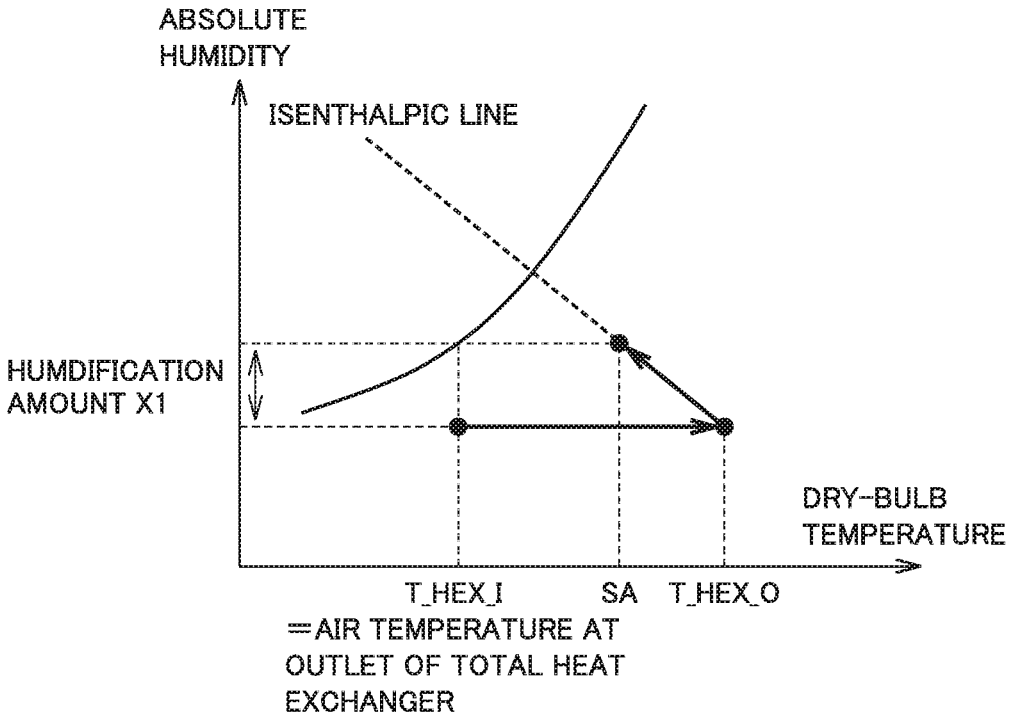
FIG. 13 is a diagram for illustrating an estimation of a state of air SA to be supplied into a room by an outside air conditioner 4.

Finally, as shown in FIG. 13, a state of air SA supplied to the room by outside air conditioner 4 can be estimated from the determined T_HEX_O and humidification amount X1.

Herein, the solid line in FIG. 13 represents a saturation curve. The arrows indicate that the temperature of air is raised from T_HEX_I to T_HEX_O by ventilation heat exchanger 38 of outside air conditioner 4. Since T_HEX_I is also necessary to determine T_HEX_O, T_HEX_I is explicitly shown in FIG. 13.

The estimated state of air SA includes temperature and humidity. The temperature of state SA is substituted for an air temperature SA_DB through the following process.

A heating amount Q_FU1 to be supplied into the room by outside air conditioner 4 can be calculated by Expression (6) below using an indoor dry-bulb temperature RA_DB [° C.], a temperature SA_DB [° C.] of air to be supplied into the room by outside air conditioner 4, an air volume W [$m^3$/s] of outside air conditioner 4, an air specific heat Cp [kJ/K*kg], and an air density ρ [kg/$m^3$].

$$Q_FU1[\mathrm{kW}] = W * Cp * \rho * (SA_DB - RA_DB) \quad (6)$$

A heating amount when outside air conditioner 4 performs the humidifying operation is also determined in a procedure similar to the procedure used when the heating and humidifying operation is performed. However, since the heating amount in ventilation heat exchanger 38 is zero, a calculation is made supposing T_HEX_O=T_HEX_I.

In order for inside air conditioner 2 and outside air conditioner 4 to avoid the "conflicting state," controller 200 displays, for example, "during waste-avoided operation" on display 212 of remote control 202 to the user when the operation state is shifted as described above, thus allowing the user to understand that the indoor heating operation is stopped and heating capability is decreased in inside air conditioner 2.

Embodiment 2

<Configuration>

Figure 14:
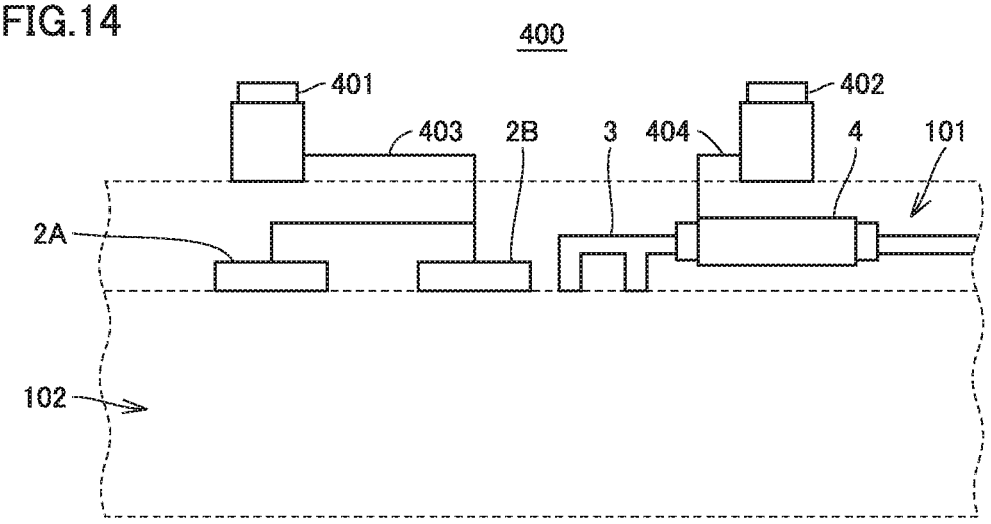
FIG. 14 shows a configuration of an air conditioning system 400 in Embodiment 2 of the present invention.
Figure 15:
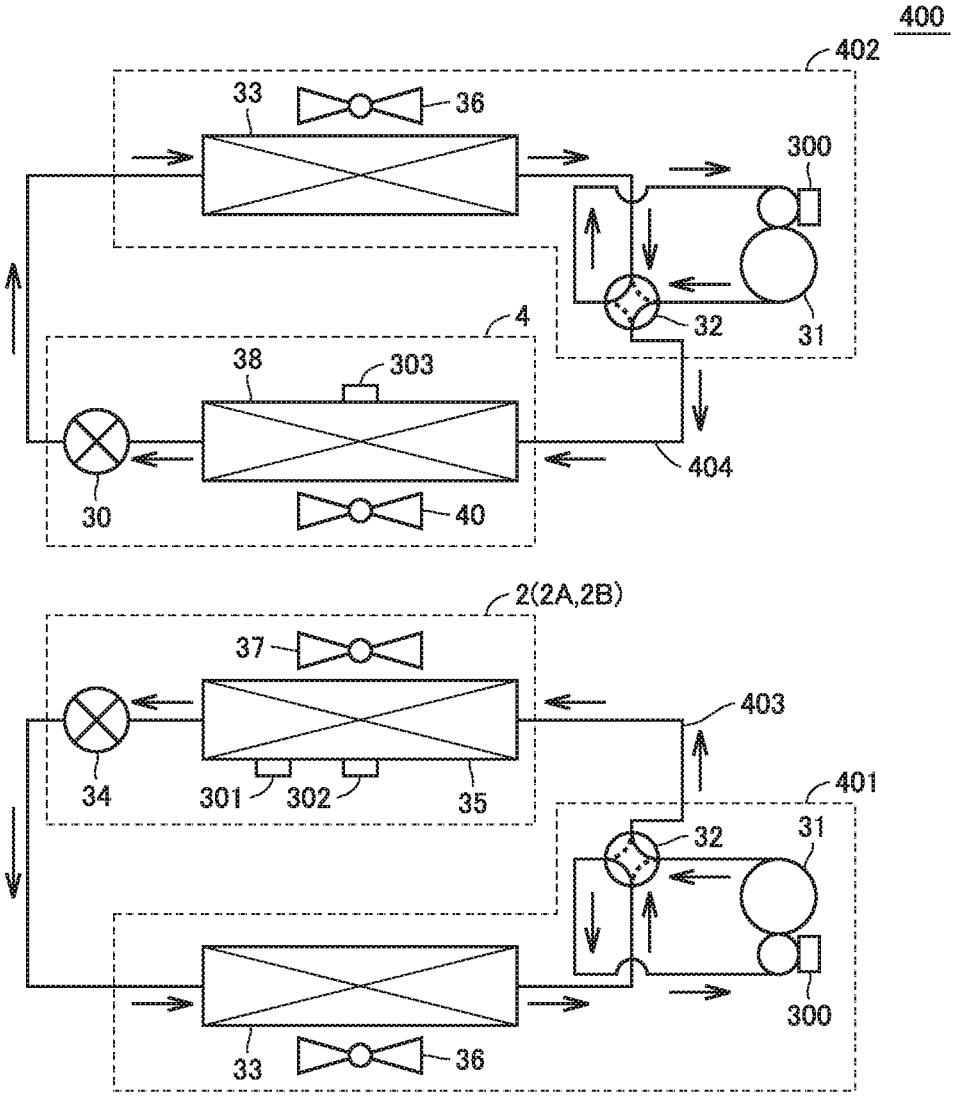
FIG. 15 is a refrigerant circuit diagram of air conditioning system 400.

FIG. 14 shows a configuration of an air conditioning system 400 in Embodiment 2 of the present invention. FIG. 15 is a refrigerant circuit diagram of air conditioning system 400.

Air conditioning system 400 is similar to that of Embodiment 1 in configuration in that it includes outside air conditioner 4, which introduces and humidifies outdoor air, and supplies the humidified air into the room, and inside air conditioners 2A and 2B, which adjust the temperature of indoor air.

Although one outdoor unit is provided in Embodiment 1, air conditioning system 400 includes two outdoor units 401 and 402. Inside air conditioners 2A and 2B are connected to outdoor unit 401 by a refrigerant pipe 403. Outside air conditioner 4 is singly connected to outdoor unit 402 by refrigerant pipe 404.

Since the configurations of outdoor units 401 and 402 are identical to the configuration of outdoor unit 1 shown in FIG. 2 and the other components and functions of equipment are similar to those in Embodiment 1, description thereof will not be repeated.

In Embodiment 2, outdoor units 401 and 402 are respectively included in inside air conditioner 2 and outside air conditioner 4. This allows the two outdoor units 401 and 402 to independently set a compressor frequency and a condensation temperature CT, so that the heating capabilities of inside air conditioner 2 and outside air conditioner 4 and the humidification capability of outside air conditioner 4 can be adjusted more easily than in Embodiment 1.

<Operations>

The operations in Embodiment 2 are similar to those in Embodiment 1 except for adjustment of heating capability and humidification capability. In other words, the operations in Embodiment 2 are similar to those in Embodiment 1 in that the "conflicting state" is avoided by processing a humidification load and then processing a heating load.

In Embodiment 1, a condensation temperature CT of the refrigerant is identical in inside air conditioner 2 and outside air conditioner 4. In Embodiment 2, however, condensation temperature CT can be set on each of the inside air conditioner 2 side and the outside air conditioner 4 side. For example, condensation temperature CT on the outside air conditioner 4 side is raised when the humidification capability of outside air conditioner 4 is increased. When the heating capability of inside air conditioner 2 is desired to be decreased in this case, control of decreasing condensation temperature CT on the inside air conditioner 2 side is performed.

The operations described with reference to FIGS. 5 to 13 are performed similarly also in Embodiment 2.

Embodiments 1 and 2 have been described above. Lastly, Embodiments 1 and 2 will be summarized again with reference to the drawings.

The air conditioning system includes a detection unit (temperature and humidity sensor 206, humidification load sensing unit 304), a ventilator (outside air conditioner 4), and an indoor unit (inside air conditioner 2). The detection unit is configured to detect the humidity of indoor air. As shown in FIG. 5, the ventilator introduces air from outside the room, heat and humidify the air, and supply the heated and humidified air into the room (S3) when the humidity detected by the detection unit is lower than a threshold value (YES in S1). The indoor unit is configured to heat the indoor air by an indoor heating operation. When the humidity detected during the indoor heating operation is lower than the threshold value (YES in S1), the electric power during the indoor heating operation is set to be smaller than when the detected humidity is higher than the threshold value (S2).

As described above, the indoor heating operation using inside air conditioner 2 is stopped depending on the magnitude of humidification load, and the heating and humidifying operation is performed using outside air conditioner 4 alone, thus proactively using the heating capability of outside air conditioner 4.

In other words, since indoor air is not heated more than necessary by inside air conditioner 2, the "conflicting state" in which the cooling and dehumidifying operation and the heating and humidifying operation are performed simultaneously can be prevented when the heating load is low and a humidification load is present.

As shown in FIG. 2, air conditioning system 103 preferably further includes outdoor unit 1 including compressor 31 configured to compress refrigerant and outdoor heat exchanger 33 configured to perform heat exchange between outdoor air and refrigerant. The indoor unit (inside air conditioner 2) and the ventilator (outside air conditioner 4) are connected in parallel to outdoor unit 1 by a refrigerant pipe. The indoor unit (inside air conditioner 2) includes indoor heat exchanger 35 and indoor expansion valve 34. As shown in FIGS. 2 and 3, the ventilator (outside air conditioner 4) includes ventilation heat exchanger 38 and ventilation expansion valve 30, and humidifier 43 that humidifies the air that has passed through ventilation heat exchanger 38. The indoor heating operation is performed by refrigerant circulating through compressor 31, indoor heat exchanger 35, indoor expansion valve 34, and outdoor heat exchanger 33 in order. The heating operation using ventilation heat exchanger 38 can be performed by refrigerant circulating through compressor 31, ventilation heat exchanger 38, ventilation expansion valve 30, and outdoor heat exchanger 33 in order. The degree of opening of indoor expansion valve 34 after a humidity condition (detected humidity<threshold value) is met during the indoor heating operation is smaller than the degree of opening of indoor expansion valve 34 before the humidity condition is met.

As shown in FIGS. 14 and 15, air conditioning system 400 preferably further includes first outdoor unit 401 and second outdoor unit 402. Each of first outdoor unit 401 and second outdoor unit 402 includes compressor 31 and outdoor heat exchanger 33. The indoor unit (inside air conditioner 2) includes indoor heat exchanger 35 and indoor expansion valve 34. The ventilator (outside air conditioner 4) includes ventilation heat exchanger 38 and ventilation expansion valve 30, and humidifier 43 that humidifies the air that has passed through ventilation heat exchanger 38. The indoor heating operation is performed by refrigerant circulating through compressor 31 of outdoor unit 401, indoor heat exchanger 35, indoor expansion valve 34, and outdoor heat exchanger 33 of outdoor unit 401 in order. The heating operation using ventilation heat exchanger 38 can be performed by refrigerant circulating through compressor 31 of outdoor unit 402, ventilation heat exchanger 38, ventilation expansion valve 30, and outdoor heat exchanger 33 of outdoor unit 402. The operation frequency of compressor 31 of outdoor unit 401 after the humidity condition (detected humidity<threshold value) is met during the indoor heating operation is zero or smaller than the operation frequency of compressor 31 of outdoor unit 401 before the humidity condition is met.

Since an outdoor unit is included in each of inside air conditioner 2 and outside air conditioner 4 in the above configuration, the heating capability of inside air conditioner 2 and the humidification capability of outside air conditioner 4 can be controlled more widely. If a humidification load is present when the heating load is low, the indoor heating operation using inside air conditioner 2 is stopped, and the heating and humidifying operation is performed using outside air conditioner 4 alone. The indoor heating operation does not need to be completely stopped but may be operated more weakly than usual. If a humidification load is present in any case, operation electric power during the indoor heating operation is reduced more than when no humidification load is present. Thus, the heating capability of outside air conditioner 4 is used proactively, and indoor air is not heated by inside air conditioner 2 more than necessary. When the heating load is low and a humidification load is present, thus, the "conflicting state" in which the cooling and dehumidifying operation and the heating and humidifying operation are performed simultaneously can be prevented.

More preferably, when the humidity condition (detected humidity<threshold value) is met once as indicated at time t2 in FIG. 6, the indoor heating operation is restarted after the heating operation using ventilation heat exchanger 38 is performed to process a latent heat load. After the latent heat load is processed by the heating operation, the humidifying operation using a humidifier is performed with expansion valve 30 closed to prevent refrigerant from flowing through ventilation heat exchanger 38.

In the above configuration, inside air conditioner 2 stops operating, and the heating and humidifying operation is performed using outside air conditioner 4. Then, after the indoor humidification load has been processed, inside air conditioner 2 starts the indoor heating operation, and outside air conditioner 4 performs the humidifying operation. In this manner, a heating load and a humidification load can be processed while avoiding the "conflicting state."

Preferably, as indicated at time t12 of FIG. 7, when the indoor heating operation using the indoor unit (inside air conditioner 2) is not performed and the heating and humidifying operation is performed using the ventilator (outside air conditioner 4), the indoor heating operation using the indoor unit (inside air conditioner 2) is performed when the indoor temperature is equal to or lower than a preset temperature.

As described above, by setting a lower limit of room temperature for inside air conditioner 2, inside air conditioner 2 starts the indoor heating operation when the room temperature is equal to or lower than the lower limit while inside air conditioner 2 stops operating. This prevents a decrease in room temperature. A heating load and a humidification load can thus be processed more promptly, maintaining comfort.

The air conditioning system preferably further includes controller 200 that controls the indoor unit (inside air conditioner 2) and the ventilator (outside air conditioner 4). As shown in FIG. 9, controller 200 preliminarily starts the heating and humidifying operation by the ventilator (outside air conditioner 4) at time t20 to time t21 before set time t_tgt set by the user, and processes the latent heat load. Controller 200 subsequently stops heating by the ventilator (outside air conditioner 4) and also starts the indoor heating operation by the indoor unit (inside air conditioner 2) at time t21.

As described above, the heating load and the humidification load can be processed by a predetermined time while avoiding the "conflicting state" by presetting the target temperature and humidity of indoor air at the predetermined time. The controllability upon startup in a day accordingly improves, so that a system more convenient for a user can be provided.

As shown in FIG. 10, the air conditioning system preferably further includes controller 200 that controls the indoor unit (inside air conditioner 2) and the ventilator (outside air conditioner 4). Controller 200 prevents or reduces the indoor heating operation of the indoor unit such that when the humidity condition (detected humidity<threshold value) is met while the indoor unit (inside air conditioner 2) performs the indoor heating operation, value Q_IU1 obtained by subtracting heating capability Q_UF1 when the heating and humidifying operation is performed on the ventilator (outside air conditioner 4) from a current heating load (Q_IU+Q_FU) serves as the heating capability of the indoor unit.

As described above, the heating capability of inside air conditioner 2 capable of processing a heating load can be determined accurately by calculating a heating load and calculating the heating capability of outside air conditioner 4 during the heating and humidifying operation from the heating capabilities of inside air conditioner 2 and outside air conditioner 4. Thus, the heating load and the humidification load can be processed simultaneously while avoiding the "conflicting state," providing a space comfortable for a user.

The air conditioning system preferably further includes display 212 that displays the operating states of the indoor unit (inside air conditioner 2) and the ventilator (outside air conditioner 4).

Displaying that inside air conditioner 2 and outside air conditioner 4 are in the operation state for avoiding the "conflicting state" as described above allows the user to understand that inside air conditioner 2 will stop the indoor heating operation or decrease the heating capability thereof, thus providing a system that a user can use without anxiety.

<Example Change in System Configuration>

For example, total heat exchanger 42 may not be provided in FIG. 3, or a fluid reservoir may be provided in front of compressor 31 in the refrigerant circuit diagrams of FIGS. 2 and 15.

It should be understood that the embodiments disclosed herein are illustrative and non-restrictive in every respect. It is therefore intended that the scope of the present invention is defined by claims, not only by the embodiments described above, and encompasses all modifications and variations equivalent in meaning and scope to the claims.

REFERENCE SIGNS LIST

1, 401,402 outdoor unit, 2, 2A, 2B inside air conditioner, 3 duct, 4 outside air conditioner, 30 ventilation expansion valve, 31 compressor, 32 four-way valve, 33 outdoor heat exchanger, 34 indoor expansion valve, 35 indoor heat exchanger, 36, 37, 40, 41 blower, 38 ventilation heat exchanger, 42 total heat exchanger, 43 humidifier, 100, 104, 106, 403, 404 refrigerant pipe, 101 space behind a ceiling, 102 interior of a room, 103, 400 air conditioning system, 200 controller, 201 main controller, 202 remote control, 204 pressure sensor, 206 temperature and humidity sensor, 211 input unit, 212 display, 300 compressor frequency control unit, 301 inside-air-conditioner heating capability sensing unit, 302 indoor temperature sensing unit, 303 outside-air-conditioner heating capability sensing unit, 304 humidification load sensing unit, 305 outside air temperature and humidity sensing unit, 306 storage unit, A supply ventilation air duct, B exhaust ventilation air duct.

The invention claimed is:

1. An air conditioning system comprising:

a controller;

a sensor configured to detect humidity of indoor air;

a ventilator configured to, when the detected humidity detected by the sensor is lower than a threshold value, introduce air from outside of a room to the ventilator, heat and humidify the air, and supply the heated and humidified air into the room; and an indoor unit configured to heat the indoor air by an indoor heating operation, wherein the controller is configured to perform the indoor heating operation when the detected humidity is higher than the threshold value and to discontinue the indoor heating operation when the detected humidity is lower than the threshold value so that the electric power consumed in the indoor heating operation when the detected humidity is lower than the threshold value is lower than electric power consumed in the indoor heating operation when the detected humidity is higher than the threshold value.

2. The air conditioning system according to claim 1, further comprising an outdoor unit including a compressor and an outdoor heat exchanger, wherein the indoor unit and the ventilator are connected in parallel to the outdoor unit by a refrigerant pipe, the indoor unit includes an indoor heat exchanger and an indoor expansion valve, the ventilator includes a ventilation heat exchanger and a ventilation expansion valve, and a humidifier configured to humidify air passing through the ventilation heat exchanger, the indoor heating operation is performed by refrigerant circulating through the compressor, the indoor heat exchanger, the indoor expansion valve, and the outdoor heat exchanger in order, a heating operation using the ventilation heat exchanger is performed by refrigerant circulating through the compressor, the ventilation heat exchanger, the ventilation expansion valve, and the outdoor heat exchanger in order, and while the indoor heating operation is performed, a degree of opening of the indoor expansion valve when the detected humidity is lower than the threshold value is smaller than a degree of opening of the indoor expansion valve when the detected humidity is higher than the threshold value.

3. The air conditioning system according to claim 2, wherein when the detected humidity falls below the threshold value, the controller is configured to start the indoor heating operation after a latent heat load is processed by the heating operation using the ventilation heat exchanger, and after the latent heat load is processed by the heating operation, the controller is configured to perform a humidifying operation with no refrigerant flowing through the ventilation heat exchanger.

4. The air conditioning system according to claim 1, further comprising:

a first outdoor unit connected to the indoor unit by a refrigerant pipe and including a first compressor and a first outdoor heat exchanger; and a second outdoor unit connected to the ventilator by a refrigerant pipe and including a second compressor and a second outdoor heat exchanger, wherein the indoor unit includes an indoor heat exchanger and an indoor expansion valve, the ventilator includes a ventilation heat exchanger and a ventilation expansion valve, and a humidifier configured to humidify air passing through the ventilation heat exchanger, the indoor heating operation is performed by refrigerant circulating through the first compressor, the indoor heat exchanger, the indoor expansion valve, and the first outdoor heat exchanger in order, a heating operation using the ventilation heat exchanger is performed by refrigerant circulating through the second compressor, the ventilation heat exchanger, the ventilation expansion valve, and the second outdoor heat exchanger in order, and while the indoor heating operation is performed, an operation frequency of the first compressor when the detected humidity is lower than the threshold value is zero or lower than an operation frequency of the first compressor when the detected humidity is higher than the threshold value.

5. The air conditioning system according to claim 1, wherein when the indoor heating operation is not performed and a heating and humidifying operation using the ventilator is performed, the controller is configured to start the indoor heating operation when an indoor temperature is lower than or equal to a preset temperature.

6. The air conditioning system according to claim 1, wherein the controller is configured to start a heating and humidifying operation using the ventilator to process a latent heat load and to subsequently stop heating by the ventilator and to start the indoor heating operation prior to a predetermined time set by a user.

7. The air conditioning system according to claim 1, wherein when the indoor heating operation is performed and the detected humidity is lower than the threshold value, the controller is configured to set a heating capability of the indoor unit to a heating capability obtained by subtracting a heating capability of the ventilator during a heating and humidifying operation of the ventilator from a current heating capability of the indoor unit.

8. The air conditioning system according to claim 1, further comprising an operation state display configured to display operating states of the indoor unit and the ventilator.

* * * * *